United States Patent [19]

Schneeberger

[11] Patent Number: 4,557,424

[45] Date of Patent: Dec. 10, 1985

[54] PACKAGE EJECTOR MECHANISM

[75] Inventor: Rudolf Schneeberger, Seuzach, Switzerland

[73] Assignee: Rieter Machine Works, Ltd., Winterthur, Switzerland

[21] Appl. No.: 543,155

[22] Filed: Oct. 18, 1983

[51] Int. Cl.[4] ..... B65H 67/00

[52] U.S. Cl. ..... 242/41; 242/18 DD; 242/35.5 R

[58] Field of Search ..... 242/41, 35.5 A, 18 R, 242/18 DD

[56] References Cited

U.S. PATENT DOCUMENTS

| | | | |
|---|---|---|---|
| 3,974,973 | 8/1976 | Lenk et al. | 242/41 |
| 3,977,615 | 8/1976 | Owens et al. | 242/41 |
| 4,007,884 | 2/1977 | Schippers et al. | 242/41 |
| 4,052,016 | 10/1977 | Cunningham et al. | 242/41 X |
| 4,304,364 | 12/1981 | Busch | 242/41 X |
| 4,309,000 | 1/1982 | Schefer et al. | 242/41 X |

*Primary Examiner*—Stanley N. Gilreath

*Attorney, Agent, or Firm*—Kenyon & Kenyon

[57] ABSTRACT

An injection mechanism is provided to eject packages from a filament winding machine. The mechanism has a shoe for engaging the end face of a bobbin which can be operated in a succession of steps so that each one of a multiplicity of bobbins can be ejected from a chuck. A locking element which employs a disc is also used to retain the shoe in the various intermediate positions.

7 Claims, 6 Drawing Figures

Figure 4:
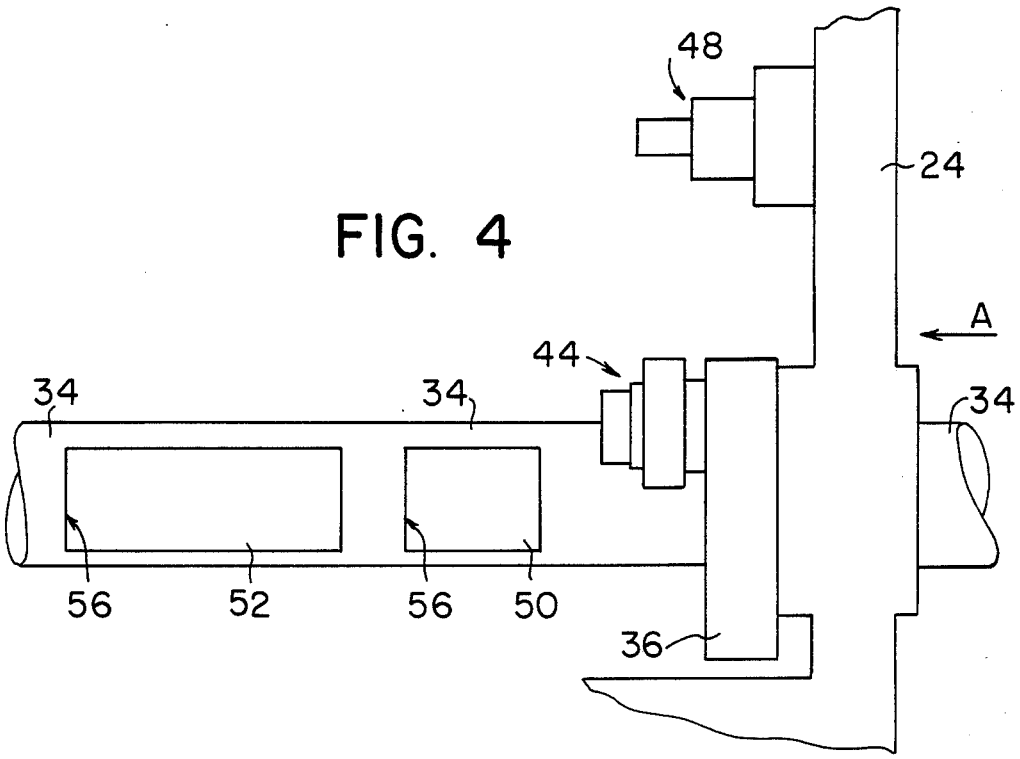

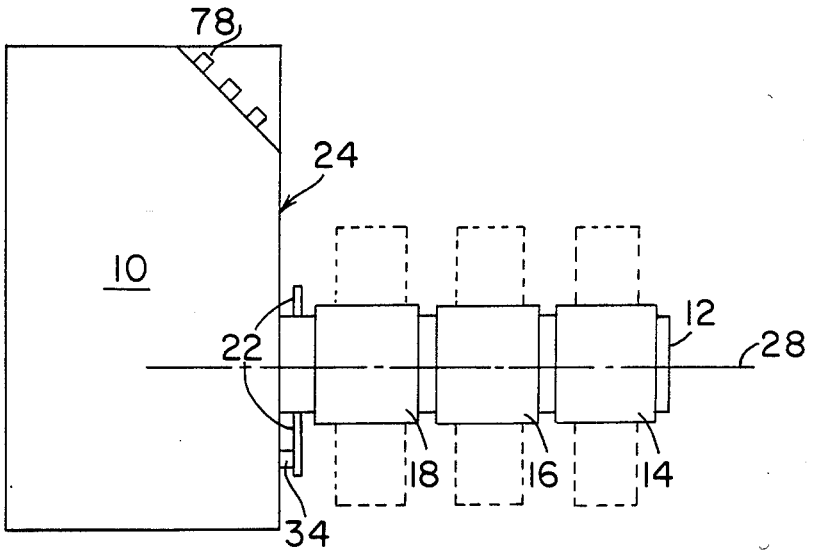
FIG. 1
FIG. 2
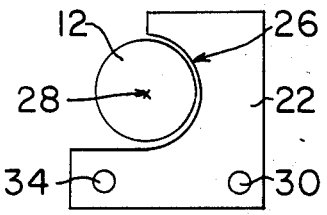
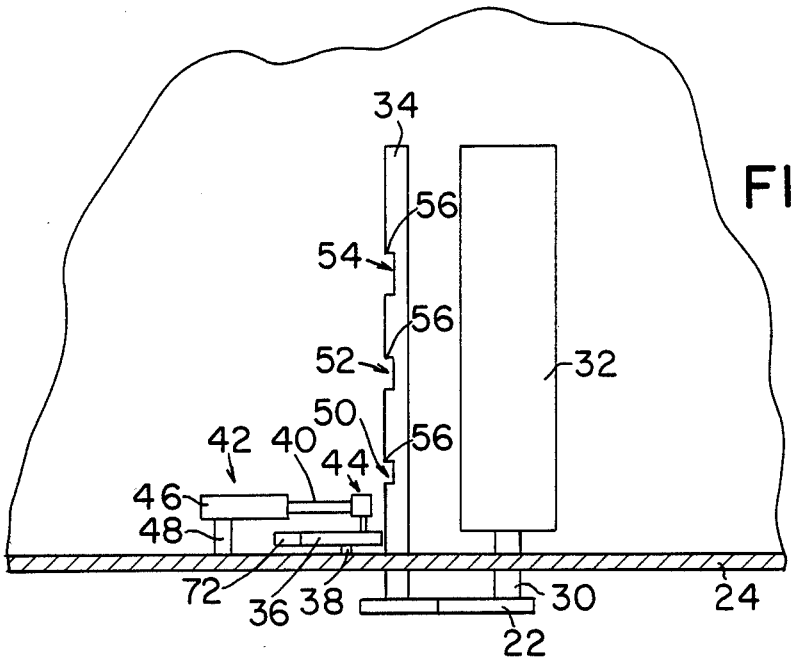
FIG. 3

PACKAGE EJECTOR MECHANISM

The present invention relates to ejection of thread packages from a package carrying member, for example, the chuck of a filament winding machine.

It is common practice to wind synthetic filaments into packages on a rotatable chuck in a filament winding machine, for example, of the type described in U.S. patent application Ser. No. 411,908 filed Aug. 26, 1982, or U.S. patent applications Ser. No. 379,134 filed May 17, 1982, or U.S. Pat. No. 4,394,985 issued July 26, 1983. Such filament winding machines commonly include an ejector or push-out mechanism operable to push the package or packages off the chuck, thus reducing the amount of work and time required of a machine attendant during doffing, i.e. removal of a full package and its replacement by an empty bobbin tube ready for the next winding operation.

In modern filament winding machines it is common practice to wind a plurality of threads simultaneously into respective packages on a single chuck. Each such thread may comprise a mono filament or, more usually, a multi filamentary structure including a plurality of individual filaments or fibrils. Up to six such threads or thread lines are commonly wound simultaneously into respective packages which must be removed successively from the supporting chuck after the latter has been brought to rest. Since the chuck is normally cantilever mounted, such ejection occurs by moving the packages along the chuck from the inboard towards the outboard end thereof.

Normal package ejection mechanisms at present in use commonly comprise an ejector or "shoe" which is movable along the chuck between retracted and extended positions. The shoe has an edge portion which partly encircles the chuck but without contacting the latter. During movement of the shoe from the retracted towards the extended position, this edge portion engages the inboard end face of the inboard bobbin tube and thereby pushes all of the tubes axially along the chuck. The ejector mechanisms are normally such that the shoe is moved continuously from its retracted to its extended position so that all packages are ejected within a very short space of time. This is not always convenient for the machine attendant.

In U.S. Pat. No. 4,351,494 and German published Patent Specification (Offenlegungsschrift) No. 2945861, an arrangement is described in which a package ejector mechanism associated with an elongate, cantilever-mounted package carrier on a package distributing carriage is operable in stages to shift a plurality of packages supported on the carrier onto respective receivers therefor. The German specification gives, however, no indication whatsoever as to how such a system can be constructed and operated.

It is an object of the present invention to enable ejection of a plurality of packages at least in controlled groups and preferably individually, such ejection being achieved by a mechanism which is simple and inexpensive in construction and operation.

The invention therefore provides an elongate member for carrying thread packages (for example, the chuck of a filament winding machine) having an associated package ejector mechanism. The mechanism includes a part movable along the member; between a retracted position and an extended position, the part being operable to push packages off the member while moving from the retracted to the extended position. A locking device is also provided and is operable to hold the part in at least one intermediate position between the retracted and the extended positions.

Preferably, the locking device is operable to hold the parts in a plurality of intermediate positions spaced along the member between the retracted and the extended positions.

Thus, the total extent of movement of the part from its retracted to its extended position is divided into a plurality of intervals. Each interval can be arranged to correspond to ejection of, preferably, a single package or at least a group of packages, the number of packages in the group being smaller than the total number of packages carried by the member.

The locking device is preferably self-locking and selectively releasable. For example, the device may be such that after release thereof the device returns to a re-lockable condition before the part has travelled through one interval of its movement from the retracted to the extended position, the locking device automatically re-engaging when the part has travelled through that interval.

The locking device may comprise a first locking element and a plurality of second locking elements, the first element being engageable successively with each of the second elements. The second elements may be movable with the part and the first element may be fixed against movement with the part. Each element may comprise an abutment. For example, each second element may comprise an abutment surface in a respective recess, the first element being engageable successively in the recesses.

The first element may be movable in directions transverse to the "ejection" direction, i.e. the direction of movement of the part from the retracted to the extended position. For example, the first element may be rotatable on an axis disposed parallel to the ejection direction. The first element may be provided by a rim portion of an eccentrically mounted rotatable body.

The package ejecting mechanism may comprise selectively operable energising means for urging the part in the ejection direction and may further comprise control means to control selective operation of the energising means. The control means may be responsive to a manually operable device, which may also be adapted to release the locking device. The control means may additionally be arranged to control selective operation of the energising means in dependence upon the condition of the locking device.

The energising means may comprise pressure fluid operated means, for example, a piston and cylinder unit. The control means referred to above may be arranged to control pressurisation of the pressure fluid operated means. For example, the control means may be adapted to pressurise the pressure fluid operated means when the locking device is released. The control means may also be arranged to de-pressurise the pressure fluid operated means before reengagement of the locking device.

Figure 5:
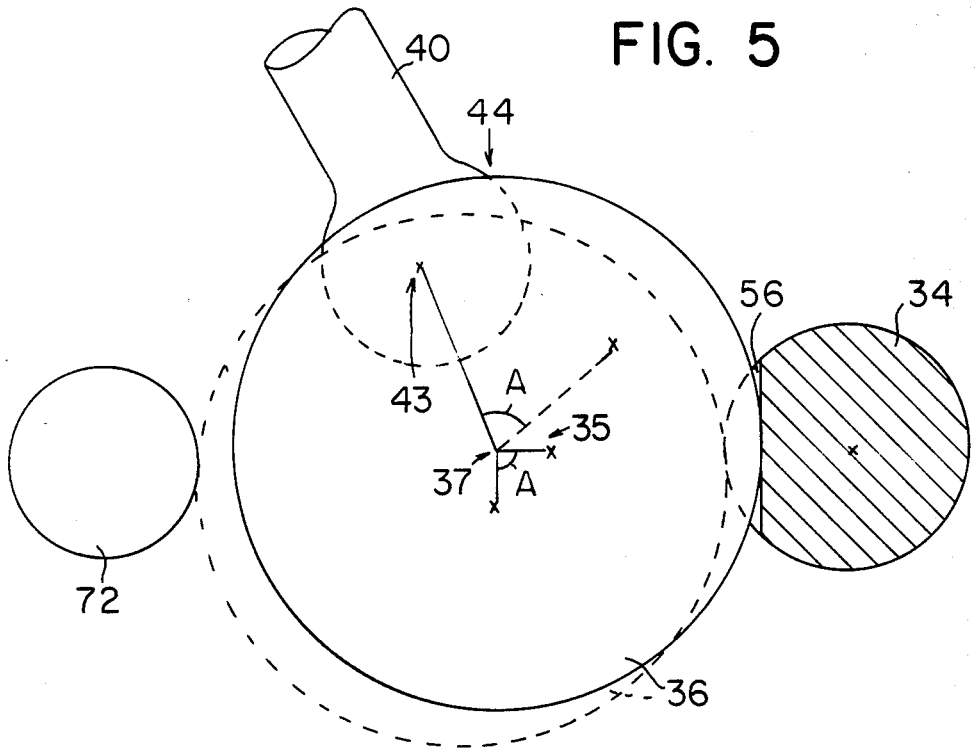
Figure 6:
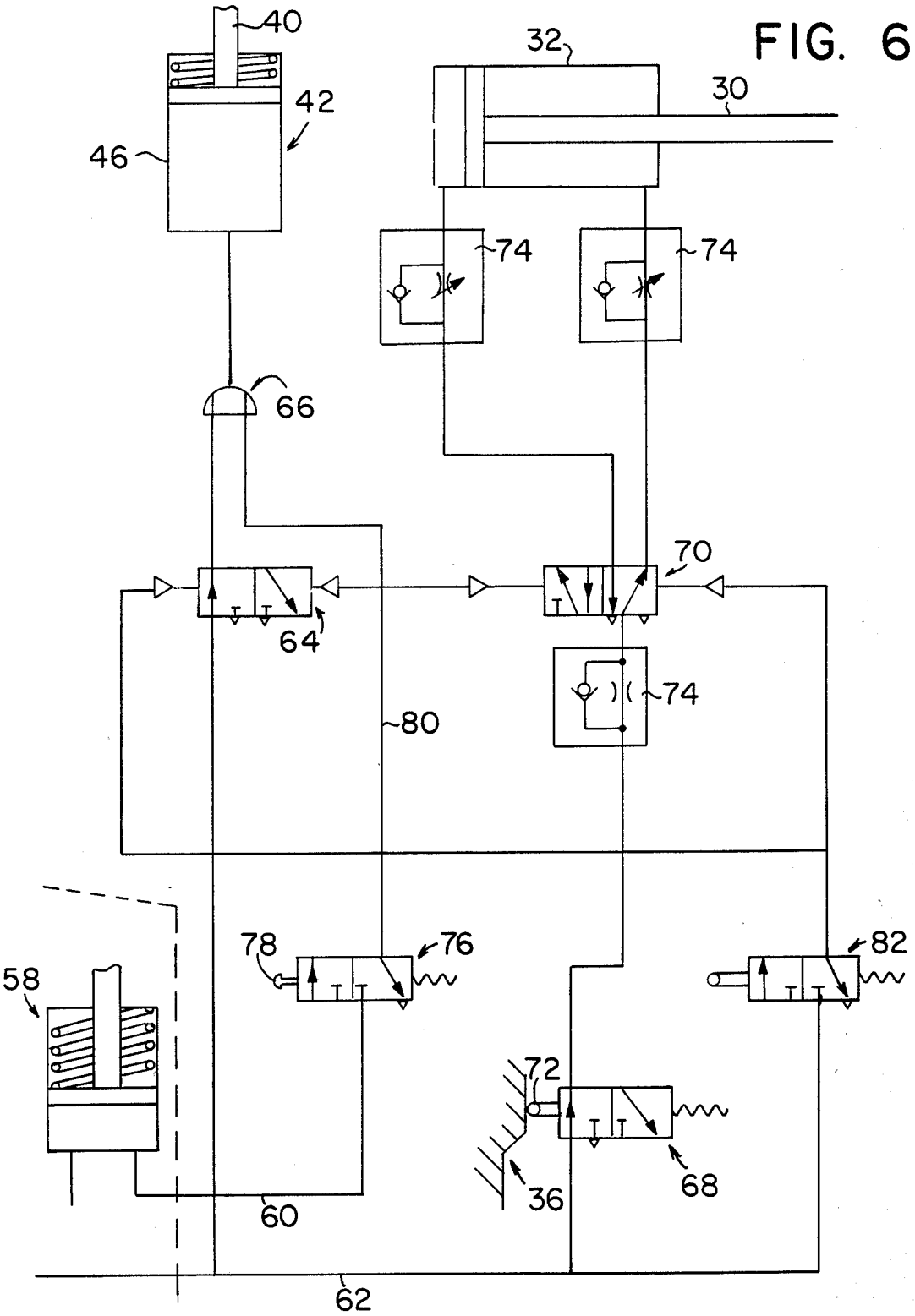

By way of example, one embodiment of the invention will now be described with reference to the accompanying diagrammatic drawings, in which FIG. 1 shows a side elevation of a filament winding machine with a mechanism according to the invention, FIG. 2 shows a front elevation of the mechanism shown in FIG. 1, FIG. 3 shows a plan view (on a different scale) of the mechanism according to the invention, FIG. 4 is a side elevation of the locking device of the package ejector mechanism of FIGS. 1–3, FIG. 5 is an elevation viewed in the direction of the arrow A in FIG. 4, omitting the front plate, and FIG. 6 is a circuit diagram of a control system suitable for use with a package ejector mechanism according to the invention.

In FIG. 1 the reference numeral 10 indicates the housing of a head stock of a filament winding machine. Within the housing 10 the head stock includes mounting, drive and control systems for the essential operating parts of the filament winder such as the package-carrying chuck 12. Details of these various systems and of the operating parts other than the chuck (for example, a friction drive roller, where provided, and a traverse mechanism) have been omitted from the illustrations, since they form no part of the present invention. For details of such systems, reference is made to the prior specifications mentioned in the introduction to this specification. Regarding the chuck 12, it is sufficient to say that this is mounted cantilever-fashion in the head stock, having a free, outboard end spaced from the housing 10. As shown in FIG. 1 chuck 12 is assumed to be designed to carry three bobbin tubes 14, 16 and 18 respectively, but the actual number of bobbin tubes in practice may vary from one to six or more.

Chuck 12 is shown in a rest condition in which it is not being driven into rotation around its longitudinal axis in order to wind thread into packages. The chuck will be in this condition before start of a winding operation and will return to this condition after the completion of the winding operation, at which stage the bobbin tubes 14, 16 and 18 will carry respective thread packages the outlines of which are indicated in dotted lines in FIG. 1.

Since the actual winding process is not of direct relevance to the present invention, it is not described herein.

When the chuck is in its rest condition after completion of a winding operation, it is partly encircled by an ejector or push-out shoe 22 which is then located between the front face 24 (FIG. 1) of the housing 10 and the inboard bobbin tube 18. As best seen in FIG. 2, shoe 22 has an edge 26 concentric with the chuck axis 28 and spaced slightly from the outer envelope of the chuck structure. This spacing is such that the edge portion of the shoe adjacent edge 26 will engage the inboard axial end face of the inboard bobbin tube 18 when the shoe 22 is moved along the chuck from its retracted position shown in FIG. 1.

Within the chuck 12, a clamping system (not shown) is provided for releasably securing bobbin tubes 14, 16 and 18 to the chuck for rotation therewith during the winding operation. When the chuck returns to its rest condition, the clamping system is normally released, a set of safety interlocks being provided to ensure that tube release is effected only after the chuck has been braked to a standstill. As will be described with reference to FIG. 6, a further safety interlock is provided so that the package ejector mechanism is operated only after the bobbin tubes have been released by the clamping system.

After the release of the tube clamping mechanism, shoe 22 can be moved from its retracted position (illustrated in FIG. 1) axially of chuck 12 into an extended position (not shown) at or adjacent the outboard end of the chuck. During this movement, after the edge portion of the shoe has engaged bobbin tube 18, as referred to above, the shoe pushes all of the bobbin tubes 14, 16 and 18 together with their packages off the chuck. If shoe 22 is moved continuously from its retracted to its extended position, then it is desirable to provide a receiver device (not shown) adjacent the outboard end of chuck 12 in order to take up the packages as they are ejected from the chuck. Where this is not possible or desired, and the machine attendant must take the packages individually from the chuck, it is desirable to operate the package ejection mechanism in a succession of stages or steps, so that in each stage one package is presented to the attendant for relatively easy removal from the chuck. A suitable mechanism, and one possible control system therefor, will now be described with reference to FIGS. 3 to 6.

The diagrammatic plan view in FIG. 3 shows the front plate 24 of the housing 10 and the shoe 22 in its retracted position. The shoe is supported on a rod 30 which extends back through the plate 24 to connect with a piston (not shown) movable in a double acting cylinder 32 suitably supported in the head stock. The shoe is additionally guided by a guide rod 34 also extending back through the front plate 24 and into the head stock and suitably supported therein by bearings (not shown) to guide the shoe for movement axially of the chuck 12. The length of the guide rod 34 therefore corresponds, without necessarily being equal, to the distance through which shoe 22 must travel from its retracted to its extended position.

A disc 36 having a central axis 35 (FIG. 5) is eccentrically mounted on a pin 38 (FIG. 3) supported by the front plate 24. Disc 36 is rotatable about axis 37 of its bearing pin 38, but is secured against axial movement relative thereto. An operating rod 40 (FIG. 5) of a piston and cylinder unit 42 is secured to the disc 36 by a pivotal connection 44 (FIG. 4), on an axis 43 offset from the axes 37 and 35. The cylinder 46 (FIG. 3) of unit 42 is pivotally secured to the front plate 24 by a suitable pivot mounting indicated at 48 in FIG. 4. When unit 42 is fully extended (FIG. 3), disc 36 is in a "withdrawn" or "release" position illustrated in dotted lines in FIG. 5. As unit 42 is retracted disc 36 rotates about axis 37 so that the radii joining axis 37 to axes 35 and 43 respectively sweep through the angle A. Disc 36 is therefore lifted into the "locked" position shown in full lines in FIG. 5, However, this movement is only possible when rod 34 is suitably positioned as will now be described.

As indicated by the previous description, disc 36 provides a locking element adapted to hold shoe 22 in intermediate positions between its retracted and extended position. In the illustrated embodiment, there are three such intermediate positions defined respectively by recesses 50, 52 and 54 formed in the side of guide rod 34 facing disc 36. Each recess has a surface 56 facing axially of the rod 34 towards the outboard end of the chuck 12. These surfaces 56 provide respective locking elements cooperable with the disc 36 to form a locking means to retain the shoe 22 in the desired intermediate positions.

As best seen in FIG. 5, when disc 36 is rotated to its release position the periphery of disc 36 lies close to but out of contact with the cylindrical outer surface of guide rod 34. So long as disc 36 is held in this release position, rod 34, and hence shoe 32, is free to move through its full stroke between the retracted and extended positions of the shoe. If, however, at the start of movement of shoe 22 from its retracted position the disc 36 is urged by unit 42 towards its engaged position then, due to the eccentricity of the mounting of disc 36, the latter will be urged first against the cylindrical outer surface of rod 34 and then into the recess 50 when the latter comes into alignment with the disc. The axial length of the recess 50 must be sufficient in relation to the thickness of the disc 36 to permit the latter to enter the recess, having due regard also to the speed with which rod 34 is moving.

If disc 36 is now withdrawn briefly from recess 50, then rod 34, and hence shoe 22, is free to continue its movement axially of the chuck. However, if disc 36 is again urged towards its engaged position before the arrival of recess 52 in alignment with the disc, then the locking procedure will be repeated when the disc and recess 52 do come into alignment. Similarly, the release and re-engagement can be repeated to bring shoe 22 into its third intermediate position defined by recess 54. In each intermediate position, the shoe 22 is retained by engagement of the axially facing surface 56 of the respective recess 50, 52 or 54 with the rearwardly facing surface on the peripheral portion of disc 36 which projects into the recess.

The spacing of surface 56 in recess 52 from surface 56 in recess 50 is equal to the spacing of surface 56 in recess 54 from surface 56 in recess 52, and these spacings are equal to the length of the bobbin tubes 14, 16 and 18. However, when shoe 22 is retracted (FIG. 3), the spacing of the surface 56 in recess 50 from the rearward face on disc 36 is less than the length of the bobbin tubes. This latter spacing is chosen so that when shoe 22 is held in its first intermediate position after leaving its retracted position, the outboard bobbin tube 14 (FIG. 1) projects beyond the outboard end of chuck 12, but is still supported by the chuck. The outboard package is therefore presented to the attendant for relatively easy manual removal from the chuck. The second and third intermediate positions of the shoe 22 then ensure that the middle and inboard bobbin tubes 16 and 18 respectively are presented in the same manner, i.e. projecting beyond but still supported by the chuck 12. Accordingly, in choosing the initial spacing between surface 56 of recess 50 and disc 36, i.e. the spacing with the shoe 22 in its retracted position, due regard must be paid to the initial spacing between the shoe 22 and the inboard bobbin tube 18 and to the length of each bobbin tube which is to project beyond the outboard end of chuck 12 when the package is presented for removal by the attendant.

One, advantageous, form of control system for a mechanism as shown in FIGS. 3–5 will now be described with reference to FIG. 6. In that Figure, the operating cylinder 32 for the ejector shoe 22, and the operating unit 42 for the disc 36 are indicated again, together with a bobbin tube clamp release unit 58. The latter does not form part of the present invention, but as already referred to above, for safety reasons the control system for the package ejection is to be rendered operable only after the bobbin clamp has released, the latter in turn being operable only after the chuck has been braked to a standstill. The clamp release unit 58 is illustrated as a piston and cylinder unit, and a lead 60 transfers pressure from this unit to the ejector control system which is shown to the right of the vertical dotted line in FIG. 6. The latter control system cannot be operated to effect package ejection until line 60 is pressurised.

Pressure is also supplied to the ejector control system via a main supply line 62 which is connected to a pressure source (not shown) supplying for example pressure air at a defined pressure (six bar is a suitable value). In the inoperable condition of the ejector control, therefore, line 62 is pressurised but line 60 is de-pressurised; in the operable condition, both lines 60 and 62 are pressurised.

The ejector control is indicated in its initial condition, with shoe 22 in its retracted position and before start of an ejection operation. The unit 42 is pressurised from line 62 via a control valve 64 and an OR-gate 66. Unit 42 is therefore held in its extended condition against a bias indicated diagrammatically by a spring within the cylinder 46 in FIG. 6. The double-acting cylinder 32 is also pressurised from line 62 via a cam controlled switching valve 68 and a control valve 70; the pressurisation is in a sense tending to hold rod 30, and hence shoe 22, in its retracted position. The cam follower 72, which controls the condition of switching valve 68, is provided by a roller contacting the periphery of disc 36, as best seen in FIG. 5. The purpose of this arrangement will become clear from the description of operation below. Various throttle units 74 are provided to control the rate of acceleration of the shoe 22.

After line 60 has been pressurised, operation of the package ejector can be triggered via a control valve 76 conditionable by a manually operable button 78 which is one of a plurality of service buttons provided in a console on the head stock 10 (see FIG. 1).

When button 78 is pressed, lead 80 is pressurised from line 60. This changes the condition of both control valves 64 and 70; consider first the effect on cylinder 32 of the change in condition of valve 70. Since there is no immediate change in the condition of valve 68, valve 70 remains pressurised from the main supply line 62. However, the sense of pressurisation of cylinder 32 is now reversed, that is, cylinder 32 is pressurised in a sense tending to urge rod 30 and shoe 22 outwardly towards their extended positions. Since disc 36 is initially withdrawn, and also there is no locking recess to hold the shoe in its retracted position, shoe 22 will move from its retracted position towards its first intermediate position, thereby shifting outboard bobbin tube 14 at least partially off the end of the chuck as already described above.

Due to the change in condition of valve 64, unit 42 is no longer pressurised from the main supply line 62. So long as button 78 remains pressed, however, unit 42 remains pressurised because lead 80 is also connected to the OR-gate 66. Accordingly, if the attendant holds button 78 in the operated condition, disc 36 will be retained in its withdrawn position, and shoe 22 will be free to continue its movement along chuck 12 without stopping at any intermediate position. This may be desired, for example, if a receiver (not shown) has been pre-placed at the end of the chuck 12 to take up packages as they are ejected from the chuck. The shoe 22 will then run to its fully extended position at which time a suitable abutment (not shown) associated with the rod 30 will operate an end switch 82 (FIG. 6), thereby reconditioning the valves 64 and 70. Shoe 22 will then be withdrawn to its retracted position and the locking mechanism will be once again held inactive by the valve 64.

If, however, button 78 is released as soon as movement of shoe 22 has commenced, then valve 64 will remain in the "lock engage" condition in which it isolates OR-gate 66 from main supply line 62. Valve 76 will return to its initial condition under mechanical bias, lead 80 will be de-pressurised and hence unit 42 will also be de-pressurised. The mechanical bias in unit 42 therefore urges this unit towards its retracted condition, that is disc 36 is rotated on its pin 38 into contact with rod 34. The spring force is insufficient to jam the system, but when recess 50 aligns with disc 36, a self-locking action is produced between disc 36 and the surface 56 in recess 50 so that shoe 22 is retained in its first intermediate position with the results already described.

Rotation of disc 36 also carries the periphery of the disc away from the follower roller 72 (FIGS. 5 and 6) so that switching valve 68 is permitted to change condition under mechanical bias as soon as the disc "drops" into the receiving recess in rod 34. Changing condition of valve 68 isolates valve 70 from the main supply line 62 and cuts off supply of pressure to the cylinder 32. Due to the throttles 74, sufficient pressure remains in the cylinder 32 to ensure contact of the abutment surface 56 with the disc 36, but the reduction in pressure in the cylinder reduces the impact between the locking surfaces.

When button 78 is pressed again, unit 42 is re-pressurised via lead 80 and disc 36 is withdrawn from recess 50. Withdrawal of the disc re-changes the condition of valve 68 so that supply of pressure to cylinder 32 is re-established from supply line 62. Rod 30 and shoe 22 are therefore free to move from the first intermediate position towards the second intermediate position. If the button 78 is immediately released, then the self-locking procedure will be repeated as soon as recess 52 comes into alignment with disc 36. The whole procedure can be repeated once again for movement from the second to the third intermediate position. Since the volume of the pressurised chamber in cylinder 32 is larger as the shoe approaches its second intermediate position than it was when the shoe approached its first intermediate position, it is desirable to vent the cylinder 32 somewhat earlier before contact between the disc 36 and the locking surface 56 of the recess 52. This gives added time for reduction of pressure in the cylinder 32 prior to the contact between the locking surfaces. Accordingly, as best seen in FIG. 4, the axial dimension of recess 52 is made longer than the corresponding dimension of recess 50. Similarly, the axial dimension of recess 54 can be made still longer than the corresponding dimension of recess 52.

The control system shown in FIG. 6 is relatively complex and is not essential to the invention. Basically a control valve, similar to the valve 70, is required to control pressurisation of the main operating cylinder 32. Means is required to control the condition of this pressurisation control valve, and it is convenient to use a manually operated control valve similar to the valve 76 and an automatically operated end switch similar to the valve 82 as the means controlling the pressurisation control valve. The same means must control operation of the locking device, that is, pressurisation of the unit 42 in the illustrated embodiment. The additional interlink between the locking device and the operating cylinder, enabling cut-off of pressure supplied to the latter prior to self-locking, is not essential but is a highly desirable variant.

In the illustrated embodiment, the disc 36 provides a single, first locking element, and the recesses in rod 34 provide a plurality of second locking elements by way of their respective surfaces 56. It would clearly be possible to provide a single, first locking element on the rod 34 and to provide a plurality of retractable, second locking elements on the head stock frame. The spacing on the recesses 50, 52, 54 can, however, be produced accurately during manufacture and this is preferable to setting of the spacing of a plurality of locking elements on the head stock frame during assembly.

It is not essential to provide a first locking element in the form of a disc nor even to arrange for rotation thereof between its withdrawn and locking condition. A lineally movable locking element is also satisfactory, but rotation is preferred since a relatively short operating stroke of the cylinder 42 can produce a substantial movement and acceleration of the rim portion of disc 36 which locks with the rod 34. An additional guide rod such as rod 34 may not be essential in all circumstances. In this case, the locking mechanism can be associated with the rod 30, for example by providing a single locking element on the latter associated with a respective plurality of locking elements on the machine frame.

It will be appreciated further that the package ejection mechanism according to the invention is not limited to use with a chuck of a filament winding machine. As referred to in the introduction to the specification, package ejection mechanisms have already been proposed for use with other elongate package carrying members, for example on a package distributing carriage as shown in U.S. Pat. No. 4,351,494. The present invention could also be applied to such alternative package carrying members.

It is not essential to use a pressure fluid operated means such as unit 42 as the moving means for operating the locking mechanism; for example only, an electromechanical arrangement could be provided to perform the same function.

Further it is not essential to provide recesses for cooperation with a locking element such as disc 36. The recesses shown in FIG. 3 could be replaced by projections which would engage the reawardly facing side of the disc. The projector could, for example, be provided by elements separate from the guide rod 34 and secured thereto at desired positions spaced therealong. The securing means could be releasable to permit adjustment of the positions of the locking elements relative to the guide rod.

I claim:

1. In a filament winding machine, the combination comprising a housing;

a chuck projecting from said housing in cantilever manner for receiving a plurality of bobbin tubes thereon;

an ejector for pushing the bobbin tubes off said chuck;

means for moving said ejector between a retracted position about said chuck and adjacent said housing and an extende position about said chuck and near an outboard end of said chuck; and locking means for locking said ejector in at least one intermediate position between said retracted position and said extended position, said locking means including a first locking element movable with said ejector and a second locking element mounted in fixed relation to said first locking element and being selectively engageable with said first locking element to lock said ejector in said intermediate position.

2. The combination as set forth in claim 1 which further comprises a rod secured to said ejector for movement therewith parallel to said chuck, said first locking element being a surface of a recess in said rod and said second locking element being movable between a locking position within said recess and an unlocking position spaced from said rod.

3. The combination as set forth in claim 2 wherein said rod includes a plurality of recesses for sequentially receiving said second locking element in locking relation, each said recess corresponding to a selected intermediate position between said retracted position and said extended position of said ejector.

4. The combination as set forth in claim 2 wherein said second locking element is spring biased toward said locking position.

5. The combination as set forth in claim 2 wherein said second locking element is an eccentrically mounted rotatable disc.

6. The combination as set forth in claim 1 wherein said means for moving said ejector is pressure operated and which further comprises a control system connected to said moving means for activating said moving means, said control system being responsive to said locking means to interrupt a supply of pressure to said moving means before said locking means locks said ejector at an intermediate position.

7. In a filament winding machine, the combination comprising a housing;

a chuck projecting from said housing in cantilever manner for receiving a plurality of bobbin tubes thereon;

an ejector for pushing the bobbin tubes off said chuck, said ejector being movable between a retracted position about said chuck and adjacent said housing and an extended position about said chuck and near an outboard end of said chuck;

a rod secured to said ejector for movement therewith parallel to said chuck;

a first locking element movable with said rod; and a second element mounted in fixed relation to said first locking element and being selectively engageable with said first locking element to lock said ejector in at least one intermediate position between said retracted position and said extended position.

* * * * *

UNITED STATES PATENT AND TRADEMARK OFFICE

CERTIFICATE OF CORRECTION

PATENT NO. : 4,557,424

DATED : December 10, 1985

INVENTOR(S) : Rudolf Schneeberger

It is certified that error appears in the above-identified patent and that said Letters Patent is hereby corrected as shown below:

Column 7, line 66 change "member;" to -member-.

Column 3, line 25 change "Fig. 1 chuck 12" to -Fig. 1, chuck 12 --.

Column 8, line 55 change "extende" to -extended-.

Signed and Sealed this

*Twenty-second* Day of *July 1986*

[SEAL]

*Attest:*

DONALD J. QUIGG

*Attesting Officer*

*Commissioner of Patents and Trademarks*